US005146702A

United States Patent [19]

Belokin, Jr.

[11] Patent Number: 5,146,702

[45] Date of Patent: Sep. 15, 1992

[54] DISPLAY HAVING AN ELECTRIC MOTOR FOR SIMULATING A FLYING OBJECT

[75] Inventor: Paul Belokin, Jr., Denton, Tex.

[73] Assignee: Martin Paul, Inc., Denton, Tex.

[21] Appl. No.: 816,731

[22] Filed: Jan. 3, 1992

[51] Int. Cl.[5] ..... G09F 19/00

[52] U.S. Cl. ..... 40/430; 40/414; 446/236

[58] Field of Search ..... 40/430, 414, 417, 449, 40/473; 446/266, 236, 229, 33

[56] References Cited

U.S. PATENT DOCUMENTS

| | | | |
|---|---|---|---|
| 106,262 | 8/1870 | Fine | 446/236 |
| 3,030,733 | 4/1962 | Crawford | 446/30 |
| 4,901,458 | 2/1990 | Belokin et al. | 40/414 |

FOREIGN PATENT DOCUMENTS

| | | | |
|---|---|---|---|
| 504444 | 4/1939 | United Kingdom | 446/229 |

*Primary Examiner*—James R. Brittain

*Assistant Examiner*—Cassandra L. Hope

*Attorney, Agent, or Firm*—Nilles & Nilles

[57] ABSTRACT

A display unit simulating a flying object and having an electric motor mounted on a support structure, a rotatably driven member drivingly engaged on the driven shaft of the motor, the driven member has a hole located adjacent its periphery, a thin, tempered wire of a small diameter is attached at one end to the driven member and the flying object is attached to the other end of the wire. One end of the wire is formed as a crank portion which is inserted loosely in the hole in the member whereby when the driven member is rotated, the wire is not bodily rotated around the member but is more slowly swung around, and the object assumes a flying fluttering motion due to the vibrations through the wire from the motor. The object is drivingly rotated in a swinging and erratic motion around the unit but at much slower rate of rotation than the motor shaft and member.

5 Claims, 3 Drawing Sheets

DISPLAY HAVING AN ELECTRIC MOTOR FOR SIMULATING A FLYING OBJECT

BACKGROUND OF THE INVENTION

1. Field of Use

This invention pertains generally to a three-dimensional movable figure display device which is used for advertising or amusement purposes and which simulates, for example, a flying insect or creature in the form of a butterfly, fly, hummingbird or bat attached to the end of a flexible wire. The wire and flying object are driven by an electric motor for rotation of the object about its support.

2. Description of the Related Art

U.S. Pat. No. 4,901,458 issued Feb. 20, 1990, and assigned to an assignee common with the present invention, discloses apparatus of the general type to which the present invention relates. In that prior art patent, however, the one end of the wire is fixed to the driven member in such a manner that the wire and its object attached to the other end bodily rotate with each rotation of the driven member. The members are driven by an electric motor of the battery operated type and at substantial speeds. Consequently, such a connection of the wire to the driven member causes undue wear and loading on the electric motor and not a gentle fluttering action of the flying object attached to the outer end of the wire.

Other examples of prior art of the general type to which the invention relates is U.S. Pat. No. 4,949,486 issued Aug. 21, 1990 in which the wire supporting the flying object is attached directly to an electrically driven shaft and rotates bodily and generally at the same speed of the the form of a bottle. At the lower end of the support is an electric motor having a ribbon directly attached to the shaft of the electric motor for rotating the ribbon rapidly to simulate a flowing liquid. Both of the latter patents are assigned to an assignee common with the present invention.

SUMMARY OF THE INVENTION

The present invention provides a display unit having a novel connection to a flexible wire which supports the flying object and the arrangement is such that a minimal load is imposed on the motor due to the loose, cranklike connection between the lower end of the flexible wire and the member which is attached to and driven by the electric motor shaft. The result is that the flying object assumes a fluttering motion due to vibrations received through the wire from the motor and the object is drivingly rotated in a swinging and erratic motion around the unit but at a much slower rate of rotation than the motor shaft.

More specifically the present invention provides a display unit simulating a flying object such as a bat, butterfly or the like and comprising an electric motor mounted on a support structure and has a rotatably driven shaft extending therefrom. A rotatably driven member is provided and has a central, generally vertically disposed hole drivingly engaged on said driven shaft, and the driven member has a second hole located adjacent its periphery. A thin wire is attached at one end to said driven member and a flying object is attached to the other end of said wire. The arrangement is such that one end of the wire is formed as a C-shaped open crank portion which is inserted loosely in the second hole whereby when the driven member is rotated, the wire and object are not bodily rotated around the driven member but are more slowly swung around. As a result the object assumes a flying fluttering motion due to the vibrations received through the wire from said motor, and the object is drivingly rotated in a swinging and erratic motion around the unit but at much slower rate of rotation than the motor shaft.

The invention provides a display of the above type in which the load on the motor is minimal due to the loose crank connection of the wire to the driven member.

A more specific aspect of the invention relates to a display unit of the above type in which the support structure is hangingly suspended and the motor is mounted with its driven shaft extending in a vertical direction. The support structure rotates in one direction while the flying object rotates in the opposite direction due to the torque of the motor and its driven shaft.

DESCRIPTION OF THE PREFERRED EMBODIMENTS

Figure 1:
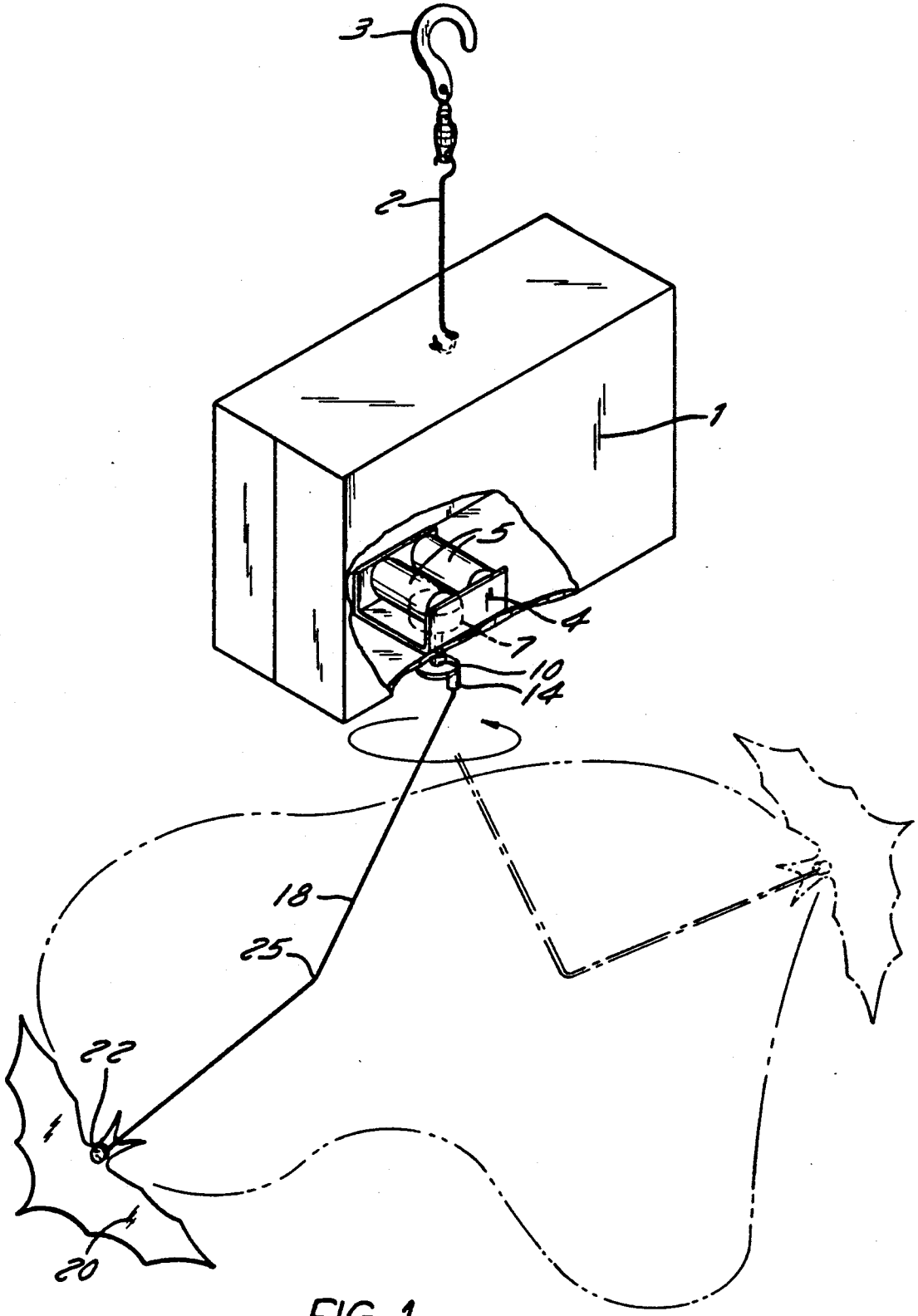
FIG. 1 is a perspective view, with parts broken away for clarity, and showing a hanging support structure with a flying object attached thereto.
Figure 2:
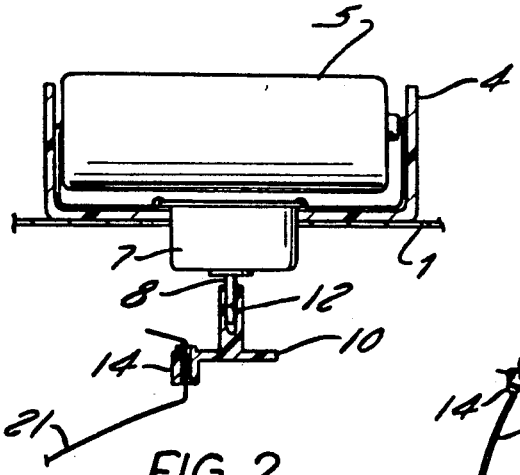
FIG. 2 is an enlarged cross-sectional view, fragmentary in nature, and showing the connection between the lower side of the hanging support structure, the electric motor attached thereto and the driving connection between the motor and the wire.
Figure 4:
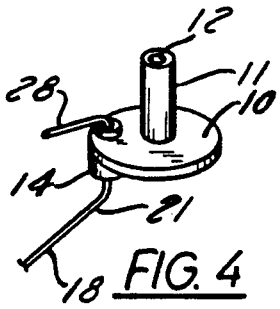
FIG. 4 is a fragmentary perspective view of the connection shown in FIGS. 2 and 3.

FIG. 1 shows a support structure 1 in the form of a rectangular box which is suspended by a wire 2 from a hook 3 which in turn finds support on a ceiling of a room or other overhead structure. Within the support structure is a battery case 4 having electrically connected therein the pair of batteries 5. The battery case 4 as shown in FIG. 2 is supported on the inside of the lower wall of the support structure and an electric motor 7 extends from the battery case 4 and through the bottom of the support structure 1 and is electrically connected to the batteries so as to provide driving rotatable power to the motor shaft 8. A lightweight plastic connecting member in the form of a disc 10 is firmly and snugly attached to the shaft 8 by its elongated hub 11 which has a central hole 12 therein that slips snugly over the motor shaft 8. Adjacent the peripheral edge of the disc 10 is an enlarged portion 14 that has a hole 15 extending thereto in a vertical direction.

A thin, tempered wire 18 of small diameter is attached at one of its ends to the driven member 10 and a flying object, such as a bat 20, bird or the like, is attached to the other end 21 of the wire, for example, by an adhesive disc 22. The flying object 20 in this instance is a simulated bat and can be folded along the dotted line 24 so as to vary its flight characteristics. The wire is bent slightly, as at 25, to provide different flight characteristics.

Figure 3:
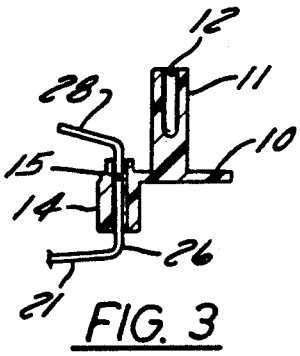
FIG. 3 is a fragmentary, enlarged, cross-sectional view of the shown in FIG. 2.
Figure 5:
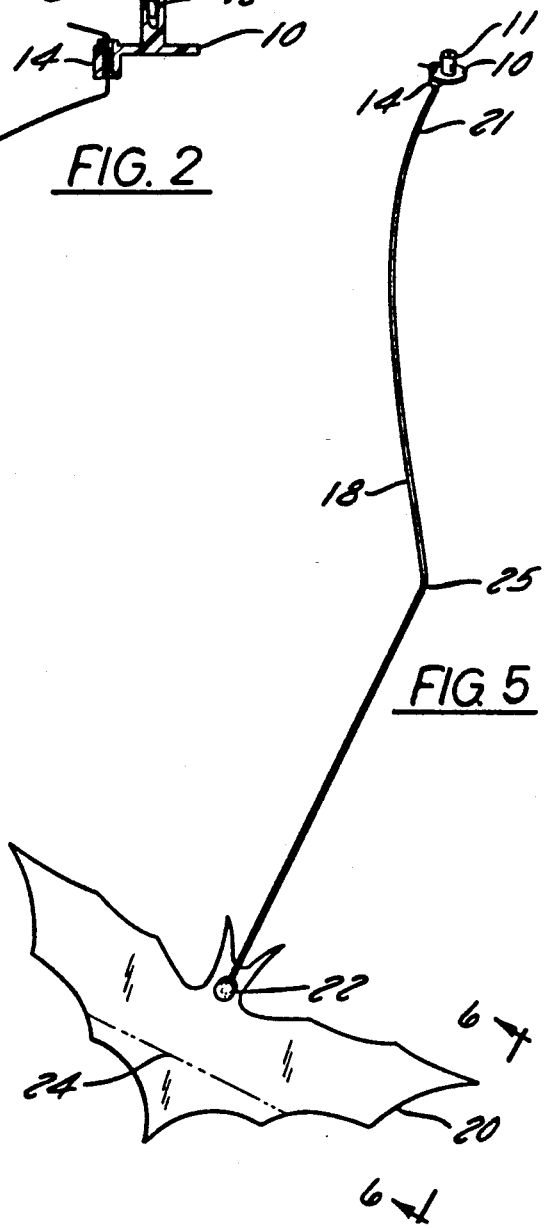
FIG. 5 is a perspective view of the flying object and its wire as attached to the connection.
Figure 6:
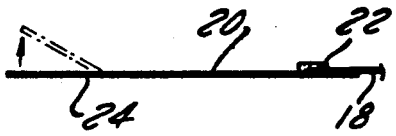
FIG. 6 is a view taken generally along the line 6—6 in FIG. 5 and showing the wire and its connection to the flying object.

The end of the wire opposite the flying object is formed as a C-shaped open crank portion 26 (FIG. 3) which can be loosely inserted in the peripheral offset opening 15 of the driven member, thus forming a loose connection therewith. The endmost part 28 of the wire is also bent so as to prevent the crank portion from falling out of the hole 15.

The arrangement is such that as the driven member is rotated, the wire is not bodily rotated around the driven member with each rotation thereof but the driven member is free to rotate even though the wire and its attached object is not bodily rotated around the member. Instead the object and its wire are rotated more slowly, that is, they are swung around the driven member in a more or less erratic motion and at a slower rate of rotation than the motor shaft and its driven member rotate. This provides a pronounced fluttering action to the flying object, such as the bat, due to the vibrations transmitted through the wire from the electric motor and the object assumes its flying fluttering motion. With the present arrangement a minimal load is imposed on the electric motor due to the loose, cranklike connection between the end of the flexible wire and the driven member to which it is attached. That is to say, the flying object is not bodily rotated around the driven member for each rotation of the driven member. If the wire were firmly attached to the driven member, the motor would be retarded in its rotation due to the load imposed because of the flying object. For instance, the electric motor may be of the type which is driven over 1000 rpm and if the flying object were attached rigidly to the driven shaft, the motor's speed would be impeded and held down to, for example, 300 rpm, thus creating a load on the motor.

Due to the torque produced by the electric motor, the suspended support structure 1 tends to rotate in one direction while the flying object rotates in another direction, thus producing a lifelike fluttering action of the object and with erratic movement.

Figure 9:
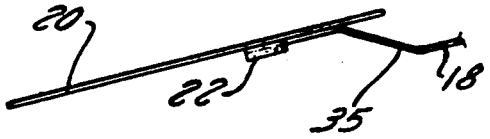
FIG. 9 is a view taken along line 9—9, on an enlarged scale, in FIG. 7 and showing the connection of the wire to the flying object.
Figure 7:
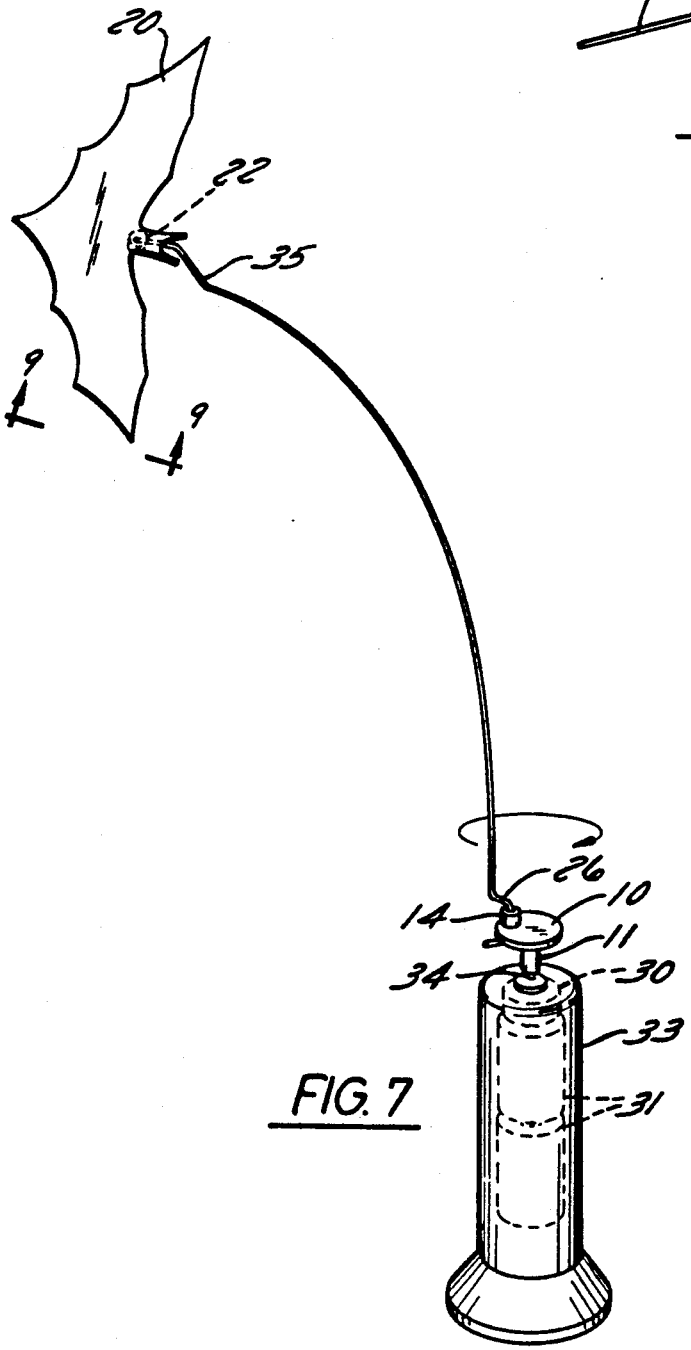
FIG. 7 us a modification of the invention and showing the three-dimensional flying object as attached to an upstanding support structure.
Figure 8:
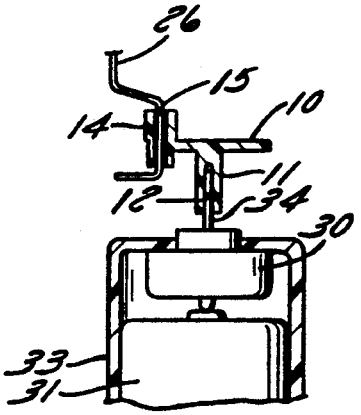
FIG. 8 is an enlarged, fragmentary, cross-sectional view of the upper end of the support structure shown in FIG. 7, the electric motor at the upper end of the support, the attachment between the wire and the electric motor.

The embodiment shown in FIGS. 7–9 shows the same cranklike loose connection between the electric motor 30 which is powered by the batteries 31 within the upstanding support structure 33. Similar numbers have been used for the driven member which connects the electric motor shaft 34 to the cranklike portion 26 of the flexible wire.

FIG. 9 again shows a simulated bat 20 as the flying object and the wire 18 in this case has an offset, bent portion 35 which holds the bat 20 away from the main wire part 18 and thus provides a slightly different flight characteristic for the bat.

RECAPITULATION

Thus, the loose crank connection of the wire with the driven member which is attached to the driven shaft of the electric motor can be utilized in either a hanging support structure or an upright stationary structure, and in either case the load on the electric motor is minimal and the flying object can assume a fluttering action and an erratic flight pattern.

What is claimed is:

1. A display unit simulating a flying object such as a bat, butterfly or the like, and comprising:

a support structure;

an electric motor mounted on said structure and having a rotatably driven shaft extending therefrom;

a rotatably driven member having a central, generally vertically disposed hole for being drivingly engaged on said driven shaft;

said driven member having a second hole therethrough and located adjacent the periphery of said driven member;

a thin, tempered wire of a small diameter attached and located adjacent the periphery of said driven member;

a thin, tempered wire of a small diameter attached at one end of said driven member, said flying object being attached to the other end of said wire, said one end of said wire bent to form a generally C-shaped open crank portion, said wire attached to said driven member by having said open crank portion inserted loosely in said second hole and rotatably freely in respect to said driven member and independent thereof, whereby when said driven member is rotated said wire is not bodily rotated in its entirety around said member with each rotation of the latter but is more slowly swung around, and said object assumes a flying fluttering motion due to the vibrations through said wire from said motor, and is drivingly rotated in a swinging and erratic motion around said unit but at much slower rate of rotation than said motor shaft and member.

2. The display set forth in claim 1 further characterized in that said support is hangingly suspended by a flexible member and rotates in one direction due to the torque of said motor, and said object rotates in the opposite direction, said motor being mounted with its shaft extending in a downward direction.

3. The display as described in claim 2 wherein said electric motor shaft is driven over 1000 rpm and produces vibrations through said wire to said object which consequently assumes a fluttering action, and said object rotates gently and slowly around said motor at a much lower speed than said shaft due to said insertion of said crank portion in said second hole of said driven member.

4. The display as described in claim 1 wherein said electric motor shaft is driven over 1000 rpm and produces vibrations through said wire to said object which consequently assumes a fluttering action, and said object rotates gently and slowly around said motor at a much lower speed than said shaft due to said insertion of said crank portion in said second hole of said driven member.

5. A display unit simulating a flying object such as a bat, butterfly or the like, and comprising:

a support structure hangingly suspended by a flexible member;

an electric motor mounted on said structure and having a rotatably driven shaft extending downwardly therefrom in a vertical direction;

a rotatably driven member having a central, generally vertically disposed hole for being drivingly engaged on said driven shaft;

said driven member having a second hole therethrough and located adjacent the periphery of said driven member;

a thin, tempered wire of a small diameter attached at one end to said driven member, said flying object being attached to the other end of said wire, said one end of said wire bent to form a generally C-shaped open crank portion, said wire attached to said driven member by having said open crank portion inserted loosely in said second hole and rotatable freely in respect to said driven member and independently thereof, whereby when said driven member is rotated independently thereof, whereby when said driven member is rotated member with each rotation of the latter but is more slowly swung member with each rotation of the latter but is more slowly swung around, and said object assumes a flying fluttering motion due to the vibrations through said wire from said motor, and is drivingly rotated in a gentle sifting and erratic motion around said unit but at much slower rate of rotation than said motor shaft and member due to said crank portion being loosely inserted in said second hole;

said motor and its shaft being electrically driven at a speed of over 1000 rpm and said support structure rotates in one direction around its hanging from said flexible member and said object rotates in an opposite direction due to the torque of said motor and its driven shaft.

* * * * *

UNITED STATES PATENT AND TRADEMARK OFFICE

CERTIFICATE OF CORRECTION

PATENT NO. : 5,146,702

DATED : Sep. 15, 1992

INVENTOR(S) : Belokin, Jr.

It is certified that error appears in the above-identified patent and that said Letters Patent is hereby corrected as shown below:

Column 4, delete lines 16-18.

Signed and Sealed this

Seventh Day of September, 1993

Bruce Lehman

*Attest:*

BRUCE LEHMAN

*Attesting Officer*

*Commissioner of Patents and Trademarks*